United States Patent [19]

Shannon et al.

[11] Patent Number: 4,530,851

[45] Date of Patent: Jul. 23, 1985

[54] PRODUCTION OF DIELECTRIC INSULATION LAYERS UPON ELECTRICAL CONDUCTORS

[75] Inventors: Michael A. Shannon, Glenburnie; John A. McDade, Kanata, both of Canada

[73] Assignee: Northern Telecom Limited, Montreal, Canada

[21] Appl. No.: 597,737

[22] Filed: Apr. 6, 1984

[51] Int. Cl.[3] ..... B05D 5/12

[52] U.S. Cl. ..... 427/9; 427/8; 427/47; 427/120; 427/128; 427/130; 427/358; 427/434.7; 118/665; 118/672; 118/689; 118/690; 118/693; 118/712; 118/125; 118/405; 118/420; 118/DIG. 18

[58] Field of Search ..... 427/9, 47, 120, 128, 427/130, 356, 358, 434.7, 8; 118/665, 672, 689, 690, 693, 712, 125, 405, 420, DIG. 18

[56] References Cited

U.S. PATENT DOCUMENTS

| | | | |
|---|---|---|---|
| 2,751,313 | 6/1956 | Speed | 427/9 |
| 3,191,132 | 6/1965 | Mayer | 333/184 |
| 3,683,309 | 8/1972 | Hirose | 333/12 |
| 4,079,192 | 3/1978 | Josse | 174/36 |
| 4,276,324 | 6/1981 | Pöhler et al. | 427/9 |
| 4,370,355 | 1/1983 | Niesse | 427/9 |

*Primary Examiner*—Richard Bueker
*Attorney, Agent, or Firm*—R. J. Austin

[57] ABSTRACT

Providing an electrical conductor with an insulation layer having a layer of dielectric carrier with magnetically permeable particles dispersed within the carrier, in which homogeneity is maintained in a fluid mixture of a fluid carrier and the particles, the conductor is moved vertically through a die means to coat it with a fluid layer of the mixture, the fluid carrier is dried and thickness of the dried insulation layer is controlled. This control is achieved by monitoring the thickness or diameter of the dried layer and, if a variation exists between the monitored and required values, the rate of fluid flow through the die means is adjusted to adjust the monitored values towards that required.

6 Claims, 8 Drawing Figures

PRODUCTION OF DIELECTRIC INSULATION LAYERS UPON ELECTRICAL CONDUCTORS

This invention relates to the production of dielectric insulation layers upon electrical conductors.

In the telecommunications cable industry, it is common practice to surround each electrical conductor with at least one layer of dielectric material which affects the electrical performance of the conductor, e.g. by producing a desired insulating effect and helping to provide other design characteristics such as mutual capacitance or mutual inductance between conductors. Inductive effect is also an important consideration and, for various reasons, continuous inductive loadings have been proposed and used in dielectric layers of electrical conductors in the telecommunications industry. These continuous inductive loadings have comprised discrete particles of magnetically permeable material, such as ferrite, which are dispersed throughout a dielectric carrier material such as a polymeric substance, e.g. polyethelene or polyvinylchloride. Dielectric layers containing particles of magnetically permeable material will be referred to in this specification as "continuous loaded layers".

If continuous loaded layers are to be produced with consistent electrical characteristics along conductor lengths, then certain manufacturing requirements need to be devised to permit sufficient control of the manufacturing process and to ensure, amongst other things, that the permeable particles are homogeneously dispersed within each layer and influence the electrical characteristics of the layer in a required manner.

The present invention provides a method and apparatus for providing an electrical conductor with a layer of insulation which is a continuous loaded layer in which the above manufacturing process problems are at least partly solved.

According to the invention, there is provided a method of providing an electrical conductor with an insulation layer comprising a layer of dielectric carrier and magnetically permeable particles dispersed within the carrier, the method comprising:

- maintaining substantial homogeneity in a fluid mixture of a fluid carrier and a quantity of the magnetically permeable particles;
- moving the conductor through the mixture and vertically through a die means to coat the conductor with a fluid layer of the mixture;
- drying the fluid carrier to form the dried insulation layer with the particles substantially homogeneously dispersed within the dried carrier; and
- controlling the thickness of the dried insulation layer by monitoring the thickness or diameter of the dried layer and, if monitored values differ from that required, varying the rate at which the fluid mixture passes through the die means to adjust monitored values towards that desired.

Preferably, the above method includes controlling the quantity of particles dispersed within the carrier by monitoring the particle quantity surrounding the conductor after emergence from the die. This monitoring is performed by passing the conductor through a magnetic field to cause the particles to influence the strength of a characteristic of the field and producing signals corresponding to this strength. Upon an evaluation of signals differing from that representing a desired quantity of particles, a control means is operated to adjust input of particles or fluid carrier into the mixture to provide the desired quantity of particles in the layer. The above monitoring is preferably performed upon the dried layer, but may, however, be performed upon the fluid layer.

It is also preferable that the quantity of particles is controlled by passing the homogeneous mixture into an application container for coating the conductor while moving the mixture through another magnetic field, and the particles influence a characteristic of this other field. Signals produced are evaluated and are used in a manner similar to that discussed in the last paragraph above to cause operation of the control means to adjust input of particles or fluid carrier to provide a desired quantity of particles in the mixture. The control means performs a primary adjustment for input based upon the signals produced from the particle measurement in the mixture and a secondary adjustment for input based upon signals produced from the particle measurement in the layer surrounding the conductor. By this particular method, a high degree of precision is obtainable for the controlling process which thus depends upon two monitoring steps at different stages of the process.

The invention also provides apparatus for providing an electrical conductor with a layer of insulation comprising a dielectric carrier and magnetically permeable particles dispersed within the carrier, the apparatus comprising:

- means to maintain a fluid mixture of carrier and particles in a substantially homogeneous state;
- a die means to coat the conductor with a layer of the fluid mixture;
- means to dry the layer to form the layer of insulation into dried form; and
- thickness control means for the dried insulation layer comprising a monitoring means to monitor the thickness or diameter of the dried layer and means to vary the rate at which the fluid mixture passes through the die means and controlled by the monitoring means, if monitored values differ from that required, to adjust the monitored values towards that desired.

The inventive apparatus preferably comprises means to control the quantity of particles dispersed with the carrier comprising a means to monitor the quantity of particles surrounding the conductor which includes magnetic field generating means to generate a magnetic field along the feedpath of the conductor downstream from the die means so that particles surrounding the conductor influence a characteristic of the field as they pass therethrough, the monitoring means also having a signal producing means to produce signals corresponding to the strength of the influenced characteristic and control means to adjust input of particles or fluid carrier into the mixture to provide the desired quantity of particles in the layer and operable upon produced signals differing from that corresponding to the desired quantity of particles.

Also, in a preferred arrangement, means is provided to control the quantity of particles dispersed within the mixture and comprises a means to monitor the quantity of particles in the mixture. This generates another magnetic field and this field extends along a feedpath of the mixture. The other magnetic field operates similarly to the first mentioned field to adjust input of particles or fluid carrier into the mixture.

Embodiments of the invention with modifications thereto, will be described by way of example, with reference to the accompanying drawings in which.

Figure 1:
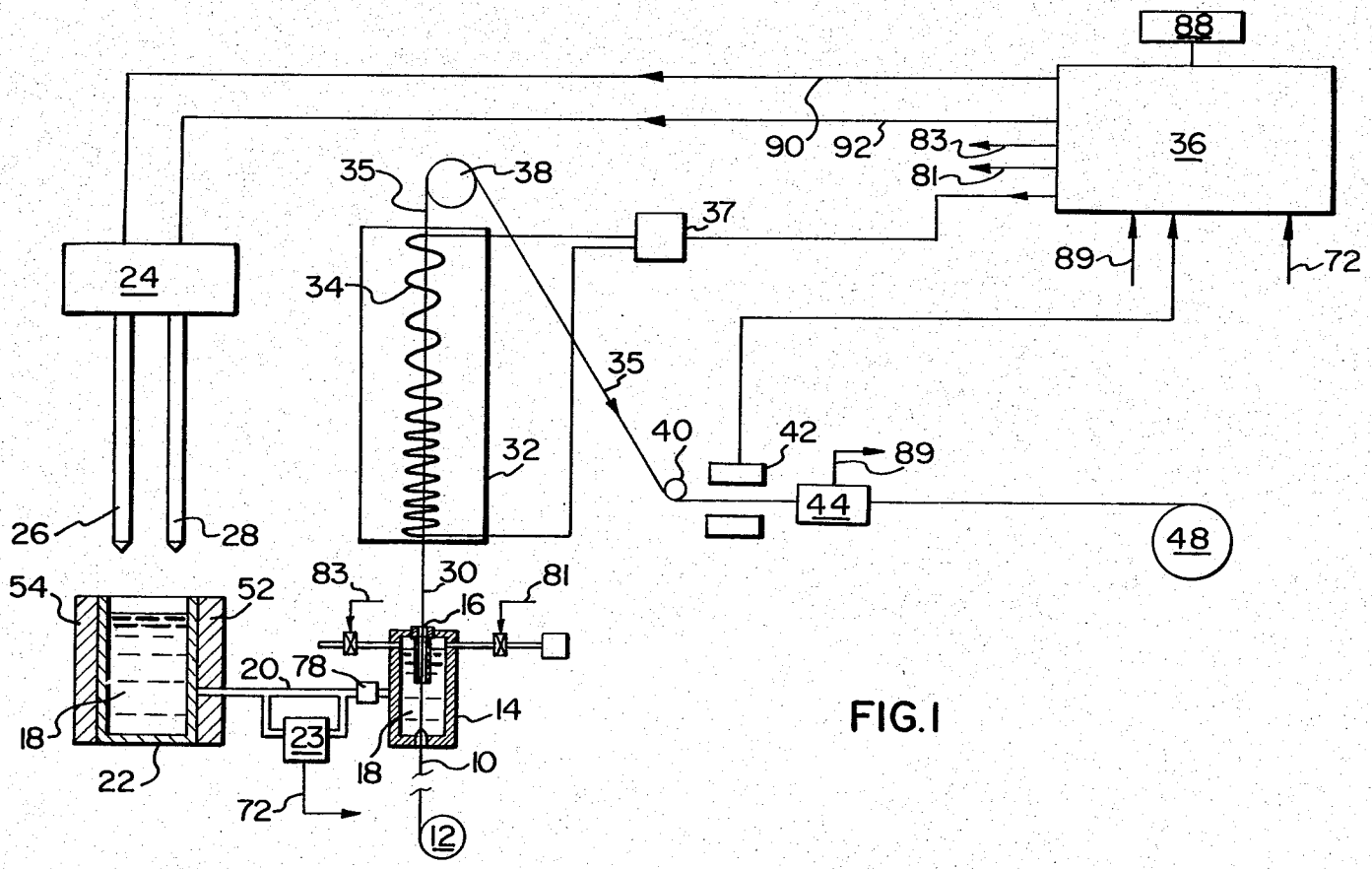
FIG. 1 is a diagrammatic side elevational view, partly in section, of an apparatus for providing an electrical conductor with a layer of insulation.

With reference to FIG. 1, an electrical conductor 10 is fed vertically along a feedpath from a give-up reel 12, through an application container 14 in which it is provided with a coat of a mixture of a fluid carrier and magnetically permeable particles and then in an upward direction through a die means 16. The mixture 18 within the container is transferred to the container through a passage 20 from a mixing container 22. A means 23 (to be described) is provided along the passage 20 for continuously monitoring the quantity of particles in the mixture and to provide signals to a microprocessor 36. These signals are evaluated to produce control signals to provide coarse control of the valve setting for the output of the separate materials, i.e. fluid carrier and particles, from a material dispenser 24 through outlets 26 and 28. The coated conductor 30, after passing through the die 16, proceeds upwardly through a drying means in the form of a vertical oven 32 within which is disposed a means to produce a net magnetic bipolar orientation of the particles towards a single direction. This means comprises a magnetic coil 34 which concentrically surrounds the feedpath. As will be described, a magnetic field is created by the coil 34 to cause magnetic bipolar orientation of the particles by a current supplied to the coil.

After passing through the oven and the coil, the coating on conductor 30 has been dried into a continuous loaded layer to form the insulated conductor 35. The insulated conductor 35 then continues around two guide pulleys 38 and 40 to pass through a diameter scanner 42, and a means 44 or monitoring the quantity of particles in the dried continuous loaded layer.

The diameter scanner which is of known structure, i.e. a biaxial laser micrometer or electron eye device, provides signals, which are evaluated by the microprocessor 36, as will be described, to produce control signals to control the thickness of the mixture which is applied by the die 16. The quantity particle monitoring means 44 sends signals to the microprocessor relating to quantity of particles in the dried loaded layer and these signals are evaluated, also to be described, to produce control signals for final and accurate adjustment of the valve setting for outlets 26 and 28, which setting is more coarsely controlled by the means 23 discussed above. After the conductor carrying the continuous loaded layer passes through the means 44, it continues onto a take-up reel 48 which is driven to provide the pulling force to move the conductor along its feedpath.

In greater detail, the structure of the apparatus is as follows.

Figure 2:
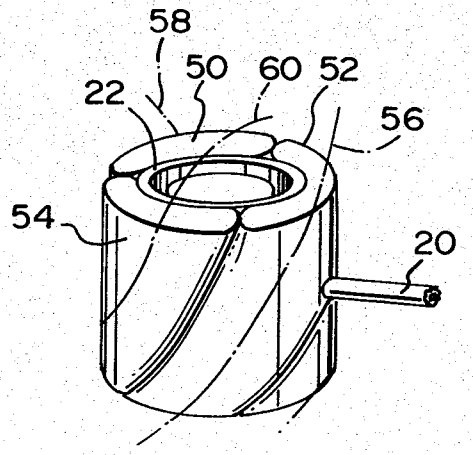
FIG. 2 is an isometric view of a mixing container of the apparatus and on a larger scale than FIG. 1.

As shown by FIG. 2, the mixing container 22 is provided with a plurality, namely three, electrical coils 50, 52 and 54 disposed, for multi-phase operation in side-by-side relationship around the container. This structure is described in greater detail in a copending application filed concurrently with this application (Ser. No. 597,603), entitled "Maintaining Homogeneity In A Mixture" in the names of J. H. Walling, M. A. Shannon and G. Arbuthnot. As described in the aforementioned specification, the mixing container is approximately 24 inches in diameter and 48 inches in height. Each of the coils 50, 52 and 54 extends around a part of the container with the coil axis extending in a circumferentially and axially inclined sense of the container. Hence, the axes 56, 58 and 60 of the coils are also inclined relative to the container axis but are inclined, in addition, relative to each other.

With the mixture 18 in the container 22 and supplied through the outlets 26 and 28, mixing is achieved and maintained in a homogeneous state by passing an electrical current through the coils in three-phase relationship. The current strength is sufficient to provide a magnetic field with the appropriate flux density to keep the ferrite particles moving relative to one another in the carrier so as to maintain the homogeneity of the mixture. The value of the current is, for any particular situation, subject to experimentation and/or calculation and may depend upon various parameters. These parameters include the diameter of the container, the viscosity of the fluid carrier and the permeability of the carrier and the particles. In this particular embodiment, the fluid carrier is a latex operating at about 20° C. and the magnetically permeable particles are ferrite particles. It is found that a field strength of approximately 10,000 gauss is suitable for the purpose. This is producible with the coils described with a current of about 100 amps and at a frequency of 60 Hz.

Because of the inclination of the axes 56, 58 and 60, the magnetic field rotates around the vertical axis of the container while being inclined to that axis. Because of the relative positioning of the axes, the inclination of the field is constantly changing with regard to the contents of the container. At any particular instant, the inclined field acts upon each ferrite particle to produce one component of movement in the particle because of the field strength at the position of the particle. In addition, a second component of movement is caused by the induced magnetic field in the particle itself. The result of movement of each particle is slightly different from every other particle in its immediate vicinity at the particular instant being considered. At a succeeding instant when the direction of inclination of the field has changed relative to the particles, new resultant movements are created in the particles. Thus, the particles are maintained in a continuously moving and mixing condition within the carrier. Apart from the inclination of the magnetic field assisting in mixing because of its change in direction, it also provides for varying circular motions of the particles to assist in the continuous mixing procedure.

The above described method of achieving homogeneity and maintaining it in the mixture has the benefit that it does not subject the carrier to a high shearing action, such as may cause agglomerations of the ferrite particles and disturb homogeneity of the mixture.

In contrast to the method described, it is known that mechanical stirring devices such as agitator paddles or recirculating pumps may cause sufficiently high shear upon a carrier such as latex with an undesirable agglomerating effect.

Figure 4:
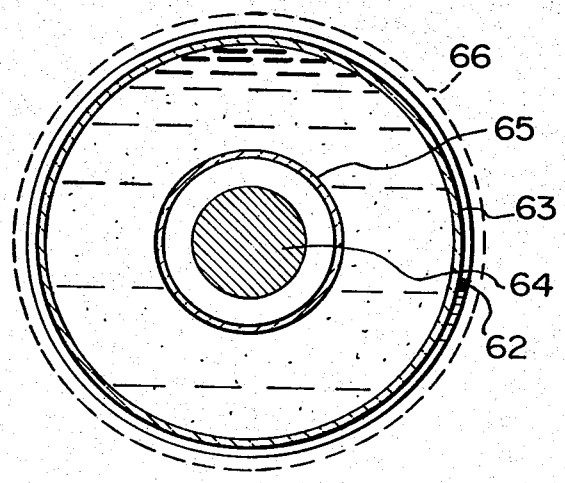
FIG. 4 is a cross-sectional view along line IV—IV in FIG. 3 of the monitoring means in FIG. 3.
Figure 3:
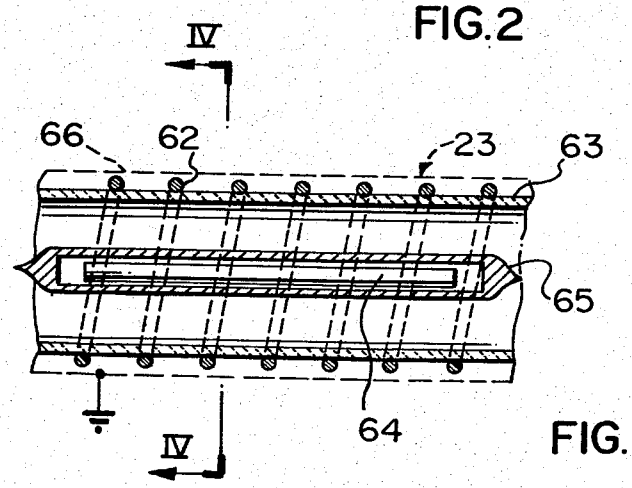
FIG. 3 is a side elevational view, partly in cross-section, of a monitoring means for monitoring quantity of particles in the mixture.

As already discussed, in moving from the mixing container 22 to the application container 14, the mixture passes through the means 23 for continuously monitoring the quantity of particles in the mixture. The monitoring means is of a construction as described in a copending application, filed concurrently with this application and entitled "Monitoring Of Magnetically Permeable Particles In A Carrier Material" (Ser. No. 597,392), in the names of M. A. Shannon and J. A. McDade. As described in that application, and shown in FIGS. 3, 4 and 5 of this embodiment, the monitoring means comprises an inductor coil 62 which is wound around a glass tube 63, which forms part of a bypass from the passage 20. Two ends of the coil are connected electrically to an oscillator 61 which operates at the resonant frequency of the electrical circuit. Within the tube 63 is disposed a metallic slug 64 and this slug is disposed within a closed tube 65 of dielectric material contained coaxially within the tube 63 by spider arms not shown. The slug is an inessential part of the apparatus but is used to control the resolution of the apparatus. A grounded electrostatic shield 66 surrounds the coil to prevent outside interference affecting measurements taken from the coil.

Figure 5:
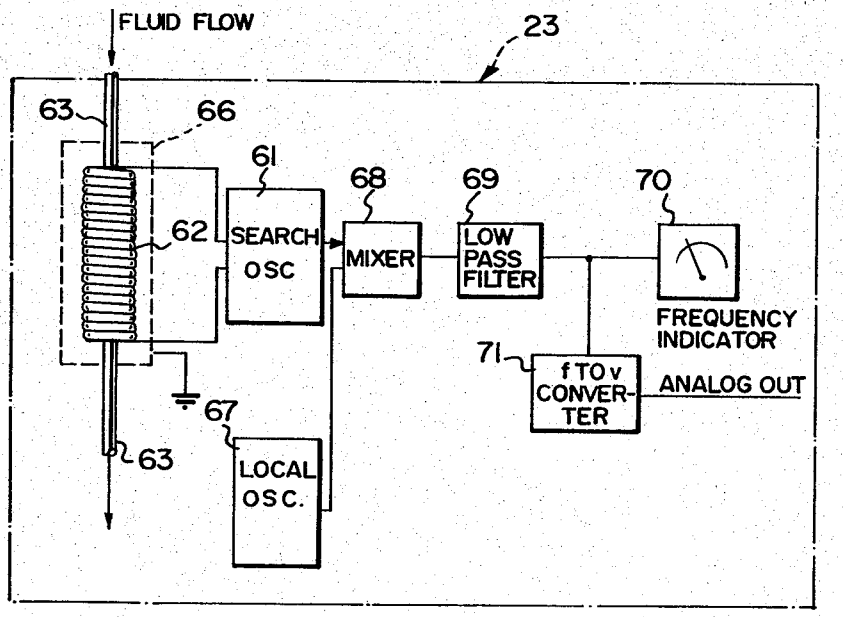
FIG. 5 is a diagrammatic representation of the monitoring means showing means to produce signals dependent upon inductance strengths in the monitoring means.

As shown by FIG. 5, a second (fixed frequency) oscillator 67 is provided and this supplies a signal corresponding to a datum oscillation of the circuit. Both oscillators are connected to a mixer 68 which combines signals received from oscillator 61 and those received from oscillator 67 and passes a resultant signal to a low pass filter 69. From the filter emerges a difference signal corresponding to the difference in frequency between the oscillators 61 and 67. A frequency counter 70 is provided for receiving signals from the filter to indicate the frequency of the circuit. In parallel with the counter 70 is a frequency to voltage converter 71 which converts the signals from the filter into an analog signal which, as shown by FIG. 1, are sent through loop 72 to the microprocessor 36. These signals are evaluated together with a datum signal in the microprocessor and issue a control signal to a dispensing controller (not shown) which is operably connected through loops 90 and 92 to the dispenser 24 to control the addition of magnetically permeable particles and fluid carrier to the mixing container 22.

In use of the apparatus with the mixture 18 flowing to the application container 14 through the passage 20, some of the material flows along the glass tube 63. With the electrical circuit energized, the coil 62 produces an inductance value, which is affected partly by the quantity of magnetically permeable particles passing through the bypass and partly by the metallic slug 64. When the coil is energized, eddy currents are set up in the slug which in turn produce an opposing magnetic field. The effective permeability of the material and the slug is a function of the magnetic composition of the mixture, i.e. the quantity of the magnetically permeable particles. Thus, the inductance of the coil at any particular time is dependent upon the quantity of particles in the fluid material and disposed within the coil. At any given time the oscillator 61 operates at a frequency dependent upon the inductance of the coil 62 as affected by the particles passing through it. This signal is sent to the mixer 68. Oscillator 67 is excited and maintained at a frequency corresponding to the natural resonant frequency of the coil 62 with no fluid passing through the glass tube 63. This frequency is sent as the datum signal to the mixer 68 and is combined with the signal from the oscillator 61 to feed into the low pass filter 69. An output signal from the filter which corresponds to the difference in frequency between the signals from the two oscillators is conveyed to the converter 71 and an analog signal is sent from there along the loop 72 to the microprocessor 36 (FIG. 1). A resultant control signal from the microprocessor is sent to the dispensing controller (not shown) and, according to the amplitude of this signal, the appropriate valve is operated as required for the purpose of controlling the rate of flow of the magnetically permeable particles or the fluid carrier through the outlets 26 and 28 into the mixing container 22.

Hence, any changes in frequency in the oscillator 61 indicate any change in the quantity of particles passing at any particular time through the coil 62. Any change in particle quantity has the effect of changing the inductance of the coil and in changing the resultant analogue signal to the microprocessor. If the quantity of particles passing through the bypass 63 is not that desired in the fluid material, then the dispensing controller is accordingly operated by microprocessor control to adjust the rate of either the particles or the fluid into the mixing container 22. Thus, the quantity of magnetically permeable particles in the material passing to the application container 14 is held between desirable limits.

Figure 6:
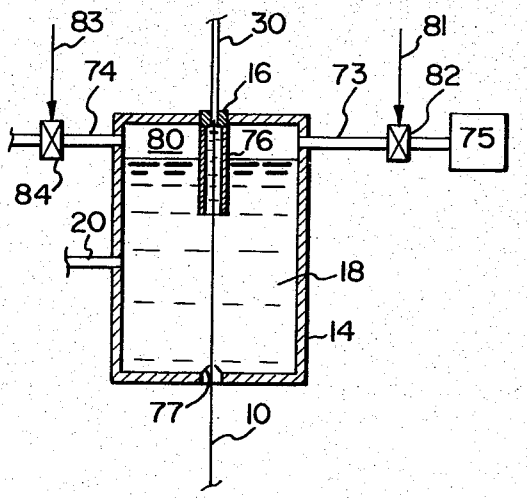
FIG. 6 is a larger scale view, partly in section, of part of the apparatus of FIG. 1.

The die means 16 in the application container is constructed according to one of the embodiments described in another copending patent application filed concurrently with this application and entitled "Production Of Insulated Electrical Conductors" (Ser. No. 597,648), in the names of M. A. Shannon and S. D. Manders. As described in that specification and more clearly shown in FIG. 6 of the present application, the application container 14 is a closed container except for the die orifice of the die means 16, a pressurized gas inlet 73 and a pressurized gas outlet 74, the inlet and outlet both being disposed towards the top of the container. The die orifice material must be sufficiently hard to prevent erosion by contact with the ferrite material in the fluid. Such a material is a ceramic material, e.g. 'Henium', manufactured by Heny Die Corporation. Other suitable materials include a diamond die insert. A sleeve 76 extends downwardly and concentrically with the die orifice to be submerged beneath the level of the material 18 in use as will be described. The mixture is pumped into the container 14 by the use of a low shear pump 78 (FIG. 1) against gas pressure in region 80 in the container 14 and above the mixture. The gas pressure is provided through inlet 73 from an air pressurizing source 75. The purpose of providing gas pressure is to pressurize the mixture 18 downwardly so as to force it upwardly within the sleeve 76 to subject the die orifice region to the pressure of the mixture. The conductor 10 is fed upwardly through a seal 77, upwardly through the mixture and outwardly through the die orifice to draw the mixture with it thereby forming the fluid coating upon the conductor. The thickness of this coating is affected, not only by the diameter of the orifice and the diameter of the wire, but also by the upwards pressure of the mixture through the orifice itself. Hence, any reduction or increase in this pressure will cause the diameter of the fluid coating to be reduced or increased respectively.

Means is provided for adjusting the pressure of the material 18 at the die orifice. This pressure adjusting means operates by changing the gas pressure in the space 80 above the mixture. An increase in pressure is controlled by a valve 82 downstream of the source 75. The pressure in the space 80 may be decreased through the outlet 74 by a further valve 84. The diameter scanner 42 is used to control opening of the valves 82 and 84 through the microprocessor 36. As the insulated conductor 35 passes the diameter scanner 42 in use, the scanner continuously monitors the diameter of the continuous loaded layer and transmits signals to the microprocessor, the signals corresponding to the measured diameter. These signals are compared with a datum signal in the microprocessor and, dependent upon any difference between the signals, then the microprocessor sends a signal to a control means comprising a multiplexer switch (not shown). The multiplexer switch then sends signals appropriately to proportional controllers of the control means and control signals are sent along loop 81 or 83 to alter the degree of opening of either valve 82 or valve 84, dependent upon whether the gas pressure above the mixture is to be increased or decreased. Hence, if the diameter of the dried continuous layer varies from that desired in either direction, then the appropriate valve 82 or 84 is opened to result in a change in pressure of the mixture at the die orifice whereby the diameter of the fluid coating upon the conductor changes appropriately to result in the desired dried diameter.

After the conductor has been provided with its controlled thickness of coating by the die means, it is then a part of the process to effect a magnetic bipolar orientation of the particles within the coating towards a single direction. This orientation procedure may be effected either before or during the drying stage. Magnetic bipolar orientation takes place by orienting the particles themselves when the coating is in a fluid state.

While a means for effecting bipolar orientation may be provided between the die means 16 and the drying oven 32, for instance, according to certain constructions described in a copending application filed concurrently with this application and entitled "Insulated Electrical Conductor" (Ser. No. 597,647) in the name of M. A. Shannon, the orienting means in this embodiment actually lies within the drying oven itself. As already discussed above, this means comprises the coil 34. As described in one embodiment of the aforementioned specification under reference (Ser. No. 597,647) the coil 34 is concentrically disposed along the feedpath and extends upwardly through the oven. The coil is connected at its ends to a source 37 of electric power. The coil is designed to reduce the strength of the magnetic field towards the downstream end of the feedpath, i.e. towards the top of the coil, and for this purpose the windings of the coil as they extend towards the top end, become further spaced apart axially of the coil so that the winding intensity is reduced. As the coated conductor 30 passes through the coil 34 and through the drying oven, it is simultaneously dried during its ascent and also the particles are subjected to their magnetic bipolar orientation towards a single direction. The flux lines of the magnetic field extend generally in the direction of the feedpath. Before entering the coil, it is possible that the ferrite particles will extend randomly in all directions within the coating on the conductor. More exactly, the magnetic bipolar orientations of the particles extend randomly. During passage of the conductor along the coil, the magnetic field influences the magnetic bipolar orientation so that the field increases the bipolar orientation towards the axial direction of the conductor by macroscopic orientation of the particles. This will reduce any abrasiveness of the surface of the dried layer associated with randomisation of the particles.

The current strength provided in the coil is controllable so as to adjust the degree of bipolar orientation of the particles. It is controlled by entry on a keyboard 88 to the microprocessor 36 which sends a signal to the power source 37 which charges the current as decided by keyboard entry so as to alter the net magnetic bipolar orientation towards the single direction and as desired.

The size of the application container is such as to ensure that the mixture is quickly removed by the conductor and replaced from the mixing container while still being homogeneously mixed. In this case, there is no particular need for including a means to ensure that the mixture is maintained in homogeneous state in the container 14. However, if the container were larger so that mixture was retained in it for a longer period, it could be necessary to include around the container 14 a means for maintaining homogeneity. This means (not shown) may be of a construction similar to that described with reference to FIG. 2 for surrounding the mixing container 22 and would include a plurality of circumferentially side-by-side coils as described above. In the case where a means is provided around the container 14 for maintaining homogeneity in the mixture in the container, it is preferable to provide a suitable shield between the container 14 and the drying oven 32 to prevent influence of one magnetic field upon the other. Shields should also be provided between other field producing areas in the apparatus as is deemed necessary for similar reasons.

From the drying oven, the conductor 30 then carrying the dried continuous loaded layer continues through the diameter scanner 42 operation of which has already been described. The biaxial laser micrometer forming scanner 42 also provides any information concerning coating eccentricity in two planes. Such information can trigger suitable operator alarms upon microprocessor evaluation.

Figure 7:
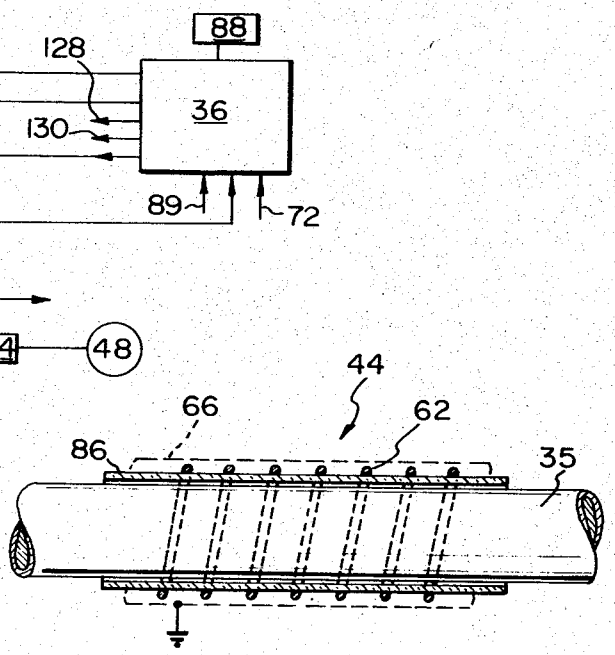
FIG. 7 is a view similar to FIG. 3 of another monitoring means.

The conductor then proceeds through the means 44 for monitoring the quantity of particles in the dried continuous loaded layer. This monitoring means is as described in one embodiment of the copending patent application entitled "Monitoring of Magnetically Permeable Particles In A Carrier Material" (Ser. No. 597,392), in the names of M. A. Shannon and J. A. McDade. The monitoring means 44 is basically of the same construction and method of operation as the monitoring means 23, but differs in the following respects as shown by FIG. 7. In FIG. 7, parts similar to those described above for the means 23 bear the same reference numbers.

As shown by FIG. 7, the monitoring means 44 differs from the means 23, in that the inductor coil 62 surrounds an open ended glass tube 86 which is disposed concentrically within the coil. The dried coated conductor 35 moves along its fixed path line through the tube as is clear from FIG. 7. The coil 62 produces an inductance value, which is affected partly by the quantity of particles passing through the tube so that the amount of particles is monitored progressively along the conductor. On the basis that the diameter of the continuous loaded layer is being maintained very closely within specified limits, then the monitoring means 44 does in fact measure the quantity of particles for that particular diameter of the layer. Thus, the apparatus in the embodiment monitors both the quantity of particles in the fluid mixture by means of the monitoring means 23, and the quantity of particles in the continuous loaded layer, with the monitoring means 44. Analogue signals sent along a loop 89 from the means 44 are evaluated in the microprocessor with the datum signal corresponding to the desired quantity of particles in the continuous loaded layer. Any departure from a required evaluation indicating that the quantity of particles is as desired, results in a control signal sent along either of the loops 90 and 92 to control the valves for the outlets 26 and 28. Thus, this control is a refinement of the control operated through the monitoring means 23 to ensure that the quantity of particles in the continuous loaded layer after drying is as required.

Hence, as may be seen from the above embodiment and according to the invention, the apparatus and the process ensure homogeneity in the mixture of materials which are to be coated onto the conductor, produces a degree of net magnetic bipolar orientation of particles in the continuous loaded layer, measures the diameter of this layer and adjusts coating thickness as necessary to maintain desired diameter and then, with the diameter fixed, controls the quantity of magnetically permeable particles in the continuous loaded layer.

In addition, any wear which does occur in the die orifice tends to result in a diameter increase of the loaded layer and this is measured by the scanner 42, thereby controlling gas pressure above the mixture and at the die orifice as described above. Hence, increase in die orifice diameter is compensated to give a constant diameter of the loaded layer.

Figure 8:
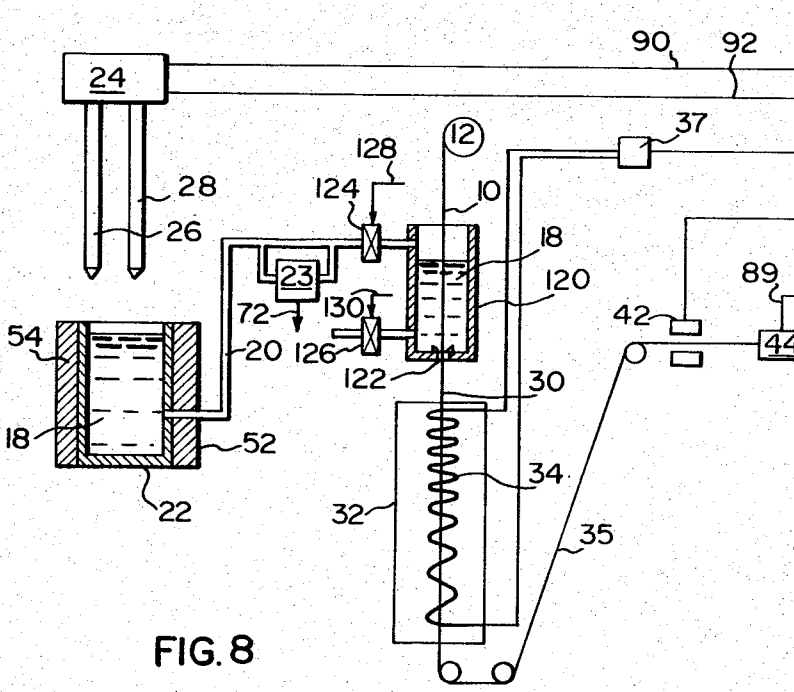
FIG. 8 is a view similar to FIG. 1 of a second embodiment.

In a second embodiment shown in FIG. 8, an application container 120 is of different construction and operates differently from that described in the first embodiment. Because of this, as will be described, the arrangement of the container 120 with the mixing container 22 and with the oven 32 is different from that of the first embodiment, but otherwise the apparatus downstream from the oven 32 is of exactly the same arrangement as in the first embodiment. In the second embodiment, parts similar to those described in the first embodiment have the same reference numerals.

The application container as shown by FIG. 8 receives the conductor 10 vertically downwardly from its reel 12. The conductor is drawn through the mixture 18 and outwards through a die orifice 122 in the base of the container at which time a layer of the mixture 18 is provided upon the conductor, itemized at 30. The conductor bearing the fluid coating then moves downwardly through the oven 32 and through the coil 34, which serves to provide bipolar orientation of the particles as described in the first embodiment. As shown by FIG. 8, the windings of the coil become further spaced apart towards its bottom end instead of the top as described in the first embodiment. The control for maintaining a substantially constant thickness of dried dielectric material upon the conductor is different from that described in the first embodiment. In the second embodiment, it is the height of the mixture 18 within container 120 which controls the pressure of the mixture upon the die and hence the rate at which the mixture flows through the die orifice. To enable the pressure around the die orifice to vary in controlled fashion, an inlet valve 124 is provided in the passage 20 as shown so as to control the rate of flow from the mixing container into the container 120. In this particular arrangement in which the mixture 18 is not pressurized by gas, the need for a pump such as pump 78 in the first embodiment is avoided. Also provided is an outlet valve 126 towards the base of the container 120 to enable the height of the mixture to be lowered if required.

In use, the distance from the surface of the mixture 18 to the die orifice is one of the parameters which decides the rate of flow of the mixture through the orifice as has already been mentioned. Thus if the height of the material is changed, the pressure around the orifice also changes and the flow rate is altered. The diameter scanner 42 operates in conjunction with the microprocessor 36 in the manner described in the first embodiment. However, the control signals sent by the microprocessor operate the valve 124 or 126 through loops 128, 130 consistent with changing the height of the mixture 18 in container 120 so as to ensure that the dried thickness of the dielectric layer upon the insulated conductor 35 is maintained substantially constant. In this case, should the signal from the diameter scanner indicate that the diameter is too great, then the valve 126 is operated to remove some of the mixture and lower the level in the container 120 so as to reduce the pressure at the die orifice. Alternatively, if the diameter becomes low as measured by the scanner, then valve 124 is opened to raise the level of the mixture 18 with the opposite results. This particular construction of container 120 together with its method of operation is described more fully in the application entitled "Production of Insulated Electrical Conductors" (Ser. No. 597,648), filed concurrently with this application in the name of M. A. Shannon and S. D. Manders.

The invention is not limited to the process and apparatus described in the above two embodiments. Modifications include other parts of apparatus as alternatives to those described. For instance, in one modification (not shown) a die means is supported upon the mixing fluid so as to be freely movable across the surface. With this arrangement, allowance is made for any lateral movement of the conductor as this is accompanied by sideways movement of the die means caused by hydrostatic pressure between the conductor and the die means. With this arrangement, the conductor and fluid insulation layer provided are maintained automatically in concentric relationship. This arrangement is described in detail in a copending application filed concurrently with this application and entitled "Production of Insulated Electrical Conductors" (Ser. No. 597,381, now U.S. Pat. No. 4,518,633), in the names of J. H. Walling, M. A. Shannon and G. Arbuthnot.

In a further modification, the monitoring means 23 is replaced by another monitoring means (not shown), such as that described in a patent application filed concurrently with this application, entitled "Monitoring Magnetically Permeable Particles In Admixture With A Fluid Carrier" (Ser. No. 597,377), and in the name of M. A. Shannon. In this particular modification and as described in the latter mentioned application, the mixture 18 is fed through helical convolutions forming part of the passage 20, convolutions being surrounded by electrical coils which are connectable to a current source in three-phase relationship. Disposed within the convolutions is a movable element such as a disc, the position of which is affected by the strength of a magnetic field created by the coils and as influenced by the quantity of particles disposed at any particular time within the convolutions. Hence, the magnetic field strength will change in the region of the element as the quantity of particles changes in the convolutions whereby the position of the movable element will also change. This position is measurable and corresponds to the quantity of particles at any particular time lying within the convolutions.

In yet a further modification, the monitoring means 44 is replaced by a monitoring means (not shown) as described in a patent application filed concurrently with this application, entitled "Production of Dielectric Insulation Layers Upon Electrical Conductors" (Ser. No. 597,393, now U.S. Pat. No. 4,514,435) and in the names of M. A. Shannon and R. J. Howat. As described in the latter application, the dried coated conductor 35 is fed through a magnetic field to cause relative movement between the source magnet for the field and the conductor as influenced by the quantity of particles in the field. The degree of relative movement is monitored to give a measurement of the quantity of particles passing through the field.

It may also be possible to control the current passing through the coil 34, so as to control the net magnetic bipolar orientation of the particles whereby this may be maintained substantially constant along the length of the conductor. For this purpose, a suitable monitoring means is provided for monitoring the net magnetic bipolar orientation of the particles and, if this orientation tends to vary along the length of the conductor, then the current fed into the coil 34 is varied so that the intensity of the field it creates is altered to alter the net magnetic bipolar orientation towards that required.

What is claimed is:

1. A method of providing an electrical conductor with an insulation layer comprising a layer of dielectric carrier and magnetically permeable particles dispersed within the carrier, the method comprising:

maintaining substantial homogeneity in a fluid mixture of a fluid carrier and a quantity of the magnetically permeable particles;

moving the conductor through the mixture and vertically through a die means to coat the conductor with a fluid layer of the mixture;

drying the fluid carrier to form the dried insulation layer with the particles substantially homogeneously dispersed within the dried carrier;

controlling the thickness of the dried insulation layer by monitoring the thickness or diameter of the dried layer and, if monitored values differ from that required, varying the rate at which the fluid mixture passes through the die means to adjust monitored values towards that desired; and controlling the quantity of particles dispersed within the carrier by monitoring the quantity of particles by passing the conductor after emergence from the die, concentrically through a magnetic field so as to cause the particles surrounding the conductor to influence the strength of a characteristic of the field and produce signals corresponding to the strength of the influenced characteristic and to the quantity of particles effectively influencing the characteristic, and upon an evaluation of signals differing from that which represents a desired quantity of particles, operating a control means to adjust input of particles or fluid carrier into the mixture to provide the desired quantity of particles in the layer.

2. A method according to claim 1, including controlling the quantity of particles dispersed within the fluid mixture by passing the homogeneous mixture into an application container for coating the conductor with a fluid layer while moving the mixture through another magnetic field as it moves towards the application container, the particles influencing a characteristic of the other field, producing signals corresponding to the influenced characteristic of said other field and to the quantity of particles effectively influencing that characteristic, and upon an evaluation of signals differing from that which represents a desired quantity of particles in the mixture, operating a control means to provide a primary adjustment for input of particles or fluid carrier into the mixture to provide the desired quantity of particles in the mixture, operation of the control means by evaluated signals associated with the quantity of particles after emergence from the die providing a secondary adjustment for the input of particles or fluid carrier into the mixture.

3. A method according to claim 2, comprising monitoring the quantity of particles in the carrier and which surrounds the conductor by monitoring the quantity of particles in the dried insulation layer.

4. Apparatus for providing an electrical conductor with a layer of insulation comprising a dielectric carrier and magnetically permeable particles dispersed within the carrier, the apparatus comprising:

means to maintain a fluid mixture of carrier and particles in a substantially homogeneous state;

a die means to coat the conductor with a layer of the fluid mixture;

means to dry the layer to form the layer of insulation in dried form;

thickness control means for the dried insulation layer comprising a monitoring means to monitor the thickness or diameter of the dried layer and means to vary the rate at which the fluid mixture passes through the die means and controlled by the monitoring means, if monitored values differ from that required, to adjust the monitored values towards that desired; and means to control the quantity of particles dispersed within the carrier comprising a means to monitor the quantity of particles surrounding the conductor which includes magnetic field generating means to generate a magnetic field surrounding and concentrically disposed relative to the feedpath of the conductor downstream from the die means so that particles surrounding the conductor influence a characteristic of the field as they pass therethrough, the monitoring means also having a signal producing means to produce signals corresponding to the strength of the influenced characteristic and control means to adjust input of particles or fluid carrier into the mixture to provide the desired quantity of particles in the layer and operable upon produced signals different from that corresponding to the desired quantity of particles.

5. Apparatus according to claim 4 and including means to control the quantity of particles dispersed within the fluid mixture which comprises a means to monitor the quantity of particles in the mixture and includes another magnetic field generating means to generate another magnetic field which extends along the feedpath of the mixture so that particles in the mixture influence a characteristic of said other field as they pass therethrough, the other monitoring means having signal producing means to produce signals corresponding to the strength of the influenced characteristic, the control means operable to provide a primary adjustment to input of particles or fluid carrier into the mixture to provide the desired quantity of particles in the mixture upon signals produced by said other monitoring means differing from that corresponding to the desired quantity of particles and to provide a secondary adjustment to input of particles or fluid carrier into the mixture upon the monitoring means for the quantity of particles surrounding the conductor producing signals differing from that corresponding to the desired quantity of particles surrounding the conductor.

6. Apparatus according to claim 5, wherein the monitoring means for the quantity of particles surrounding the conductor has its field generating means located to generate its field downstream along the feedpath from the drying means.

* * * * *